US005224267A

United States Patent [19]

Simms et al.

[11] Patent Number: 5,224,267

[45] Date of Patent: Jul. 6, 1993

[54] SAFETY RAZORS

[75] Inventors: Graham J. Simms; Brian Oldroyd, both of Reading, United Kingdom

[73] Assignee: The Gillette Company, Boston, Mass.

[21] Appl. No.: 828,962

[22] PCT Filed: May 28, 1991

[86] PCT No.: PCT/US91/03752

§ 371 Date: Feb. 5, 1992

§ 102(e) Date: Feb. 5, 1992

[87] PCT Pub. No.: WO91/19597

PCT Pub. Date: Dec. 26, 1991

[30] Foreign Application Priority Data

Jun. 11, 1990 [GB] United Kingdom ..... 9012979
Jul. 19, 1990 [GB] United Kingdom ..... 9015898

[51] Int. Cl.[5] ..... B26B 21/00; B26B 21/14; B26B 21/16

[52] U.S. Cl. ..... 30/50; 30/77; 30/87

[58] Field of Search ..... 30/32, 42, 50, 87, 60, 30/77, 346.58

[56] References Cited

U.S. PATENT DOCUMENTS

| | | | |
|---|---|---|---|
| 3,872,588 | 3/1975 | Boghty . | |
| 4,407,067 | 10/1983 | Trotta | 30/77 |
| 4,443,940 | 4/1984 | Francis et al. | 30/87 |
| 4,551,916 | 11/1985 | Jacobson | 30/346.58 |
| 4,574,476 | 3/1986 | Ortiz . | |
| 4,586,255 | 5/1986 | Jacobson | 30/50 |
| 4,813,131 | 3/1989 | Gruner | 30/50 |
| 4,860,449 | 8/1989 | Duncan | 30/60 |
| 4,932,122 | 6/1990 | Shurland et al. | 30/50 |

*Primary Examiner*—Douglas D. Watts
*Assistant Examiner*—Paul M. Heyrana, Sr.

[57] ABSTRACT

Safety razors comprise frames in which blade members are mounted in such a manner as to permit their angular displacement to change their shaving angle in use. The blade members are pivotally or hingedly mounted and are spring biassed to a normal position in which their shaving angles are at a maximum value. When, in use, the razor experiences high drag forces, the blade members are caused to move so as to reduce their shaving angles. The blade members may respond directly to drag forces applied to them or indirectly in response to deflection of guard members under high drag forces.

12 Claims, 8 Drawing Sheets

SAFETY RAZORS

This invention relates to safety razors of the form comprising a frame supporting one or more blade members in a manner permitting movement of the blade members, against resilient restoring forces, in response to forces encountered in use.

A well known example of a safety razor of this general form is disclosed in U.S. Pat. No. 4,492,025 in which the individual blade members of a tandem pair are displaceable against the action of restoring springs in directions perpendicular to a notional plane tangent to fixed guard and cap surfaces before and behind the blade edges so as to reduce the exposure of the blade edges in response to increased forces applied to the edges by the skin in use, whether due to changing skin contours or increased pressures applied by the user's hand or a combination of both.

The present invention is mainly characterized in that the (or each) blade member is movably mounted in the frame in such a manner that the shaving angle of the (or each) blade is reduced when in use the razor encounters increased drag forces, that is to say forces acting substantially parallel with the direction of shaving.

The term "shaving angle" is used herein in its normal sense in the art to indicate the acute angle formed between the median plane of a blade member and a notional plane tangent to the skin engaging members immediately ahead of and behind the blade member. In the case of a single blade razor, these would be the guard and the cap members. In a tandem edged razor, the respective skin engaging members are constituted by the guard and the second blade edge, or the first blade edge and the cap.

In some embodiments of the invention, the razor has a guard member which is displaceable relative to the frame and whose rearward displacement, against the action of resilient restoring forces, is transmitted to the blade members to cause them to pivot or hinge about axes parallel with the blade edges. The guard member may be constrained to move only in directions parallel to the shaving direction or it may be mounted for compound movements in these directions and perpendicular thereto to take account of drag forces and of forces normal thereto.

In another embodiment, it is the increased drag forces sensed by the blade edges which cause the shaving angles of the blades to be reduced.

A principle factor in the magnitude of drag forces is the direction of the grain of the beard, which is different in different regions of the face. For many people, the hair on the cheeks emerges from the skin at an angle thereto, sloping downwardly. Thus, a "downstroke" in these regions is essentially "with the grain". Many men prefer to shave with downstrokes and with "upstrokes" ("against the grain") to obtain a closer shave. Greater drag forces are experienced by the razor in these strokes against the grain. Also, facial skin shows a greater tendency to bulge when a razor is moved up the face, particularly over the cheeks and this also tends to increase the drag forces experienced by the razor.

The shaving angle of blades in modern razors is normally pre-set in manufacture at about 22°-25°, which is found to provide an optimum angle of attack between the blade edge and the hairs for efficient cutting, but is necessarily a compromise, bearing in mind that most hairs do not emerge from the skin at right angles thereto. Hence, when shaving with a downstroke so that the blade edges are moving with the grain a relatively high shaving angle is desirable for the blades, but when shaving with an upstroke and the blade edges are moving against the grain a relatively shallower shaving angle is desirable for the blades. In selecting a constant shaving angle for the blades the conflicting requirements of these different shaving conditions must be balanced and a compromise accepted.

With the razors of the present invention, reduction of the shaving angle, in response to increased drag arising from shaving against the grain, tends to bring the blade edge closer to its optimum angle of attack.

A razor according to the invention can have blade members arranged so that they are biased to positions in which the blade edges have a shaving angle which is the optimum when drag forces are low, i.e. when shaving with the grain, but the blades adapt in response to large drag forces being applied so that the shaving angles of the blades are reduced to suit those conditions when shaving against the grain. As a result the drawback of having to settle for a constant shaving angle for the blades, which angle is a compromise of the range of optimum shaving angles, is averted.

Some safety razors in accordance with the invention will now be described in detail, by way of example, with reference to the accompanying drawings, in which.

Figure 4:
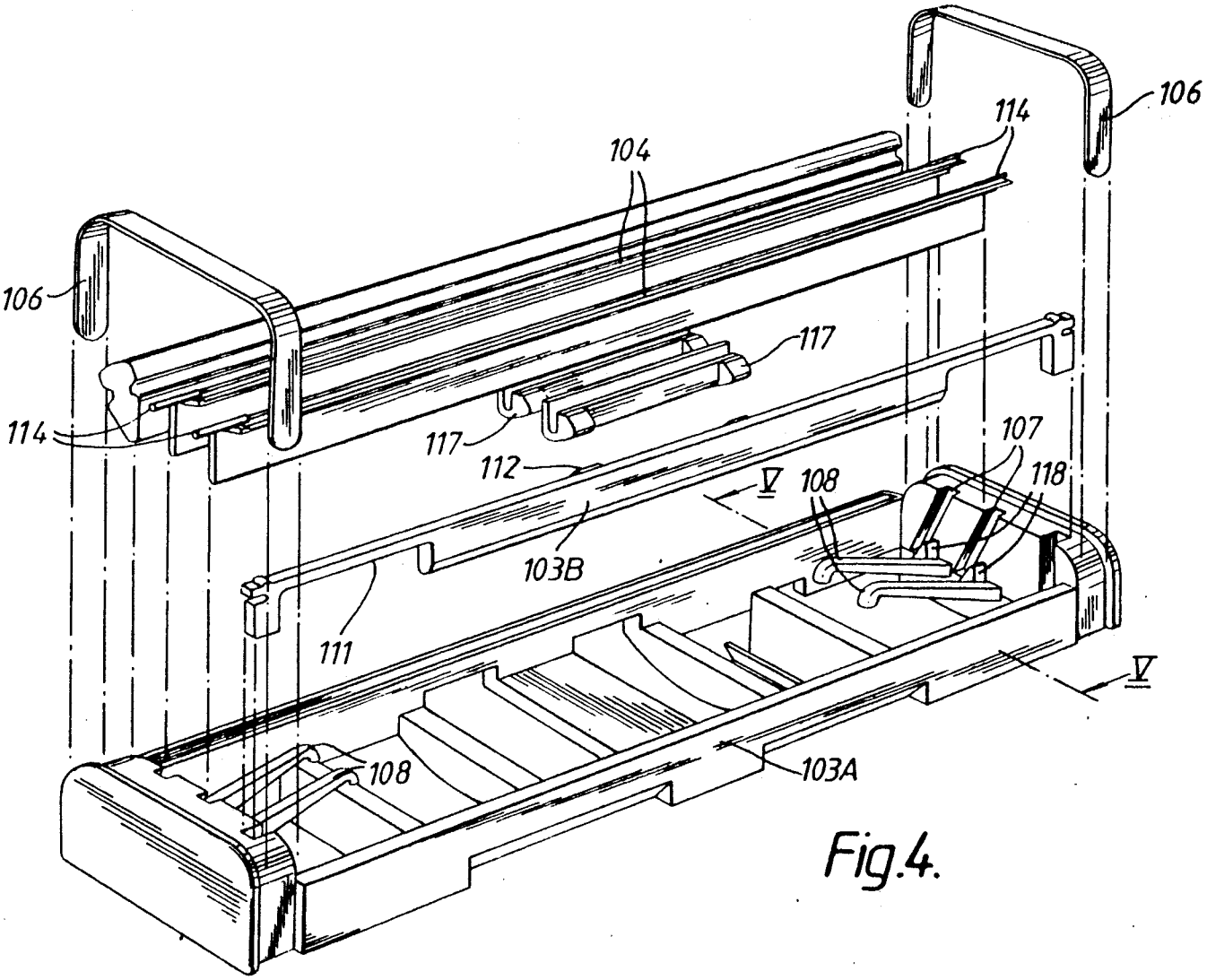
FIG. 4 is an exploded perspective view of another form of razor head.
Figure 5:
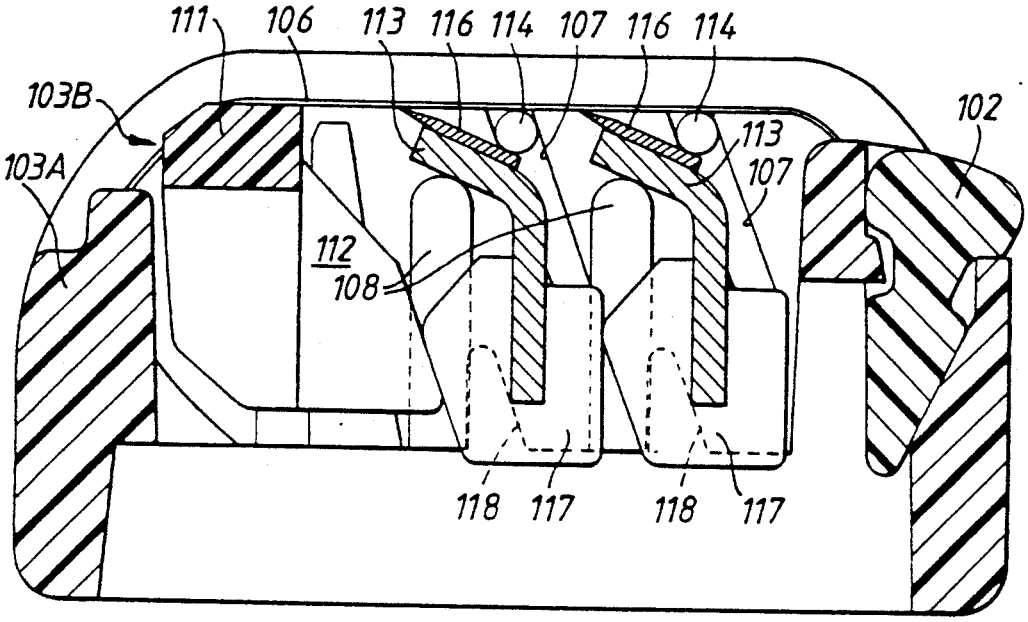
FIGS. 5 and 6 are cross-sections taken along the line V—V of FIG. 4 with parts being shown in different operative positions.
Figure 6:
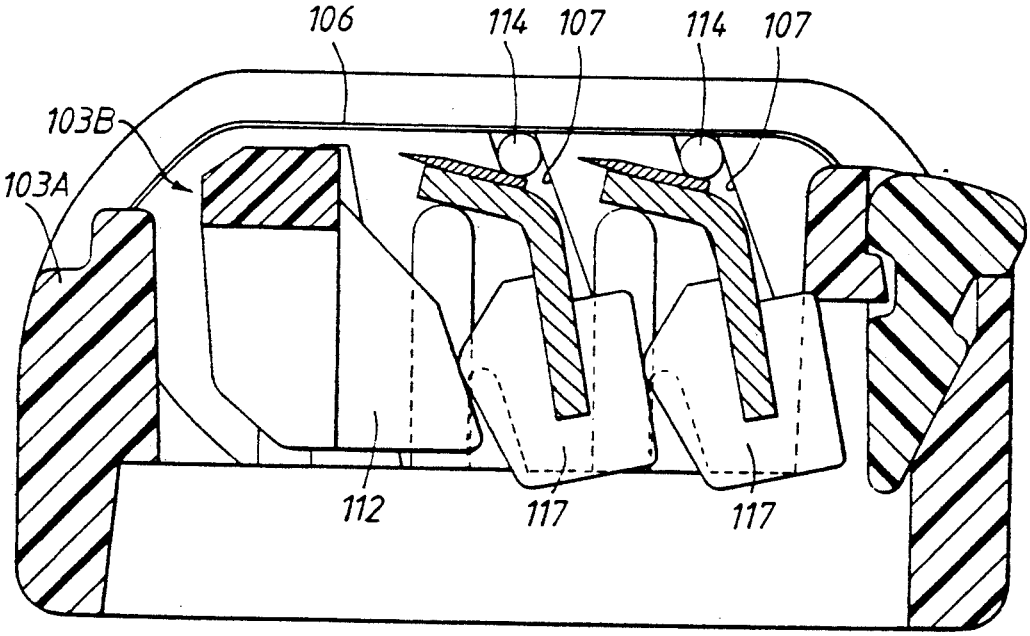
Figure 11:
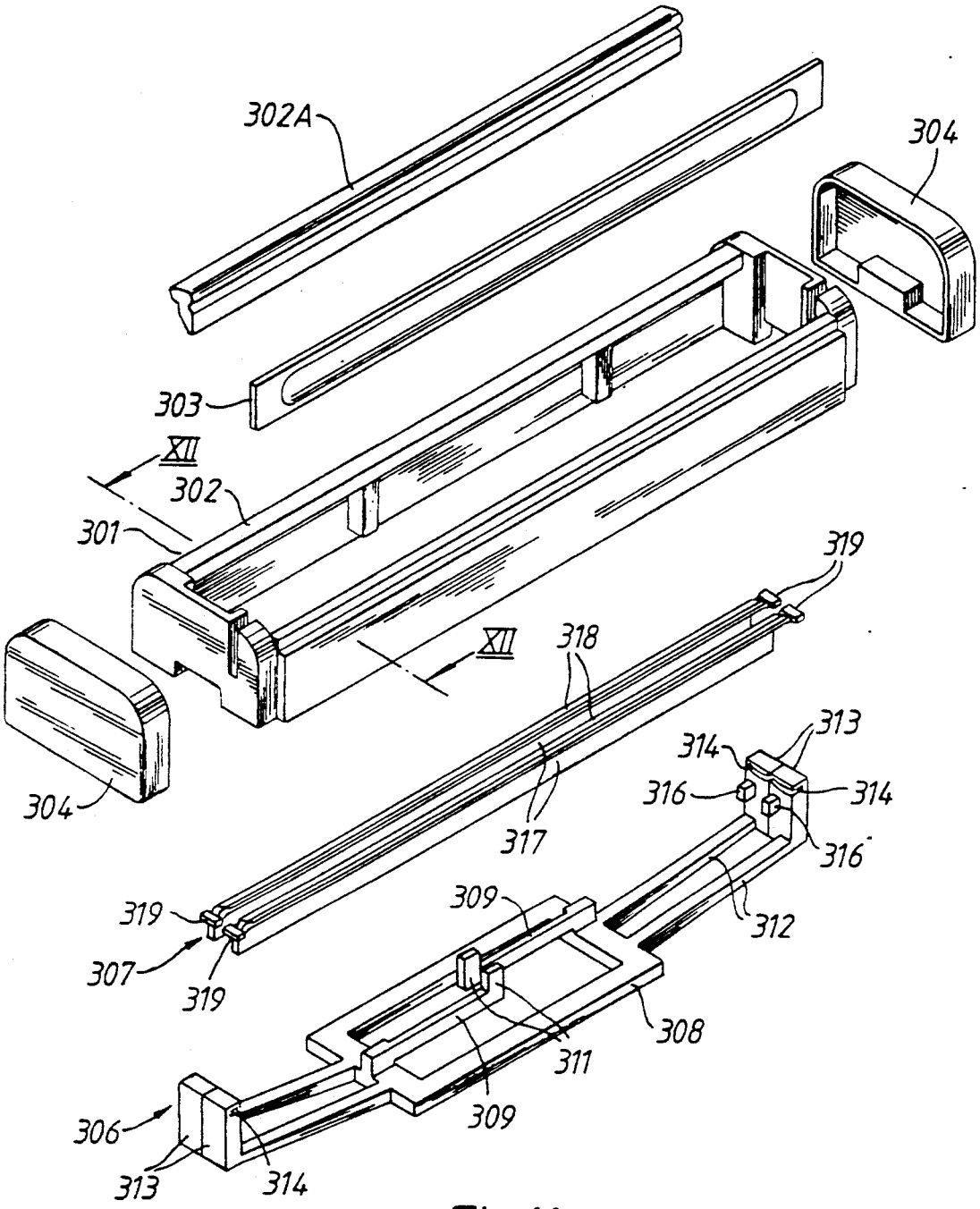
Figure 12:
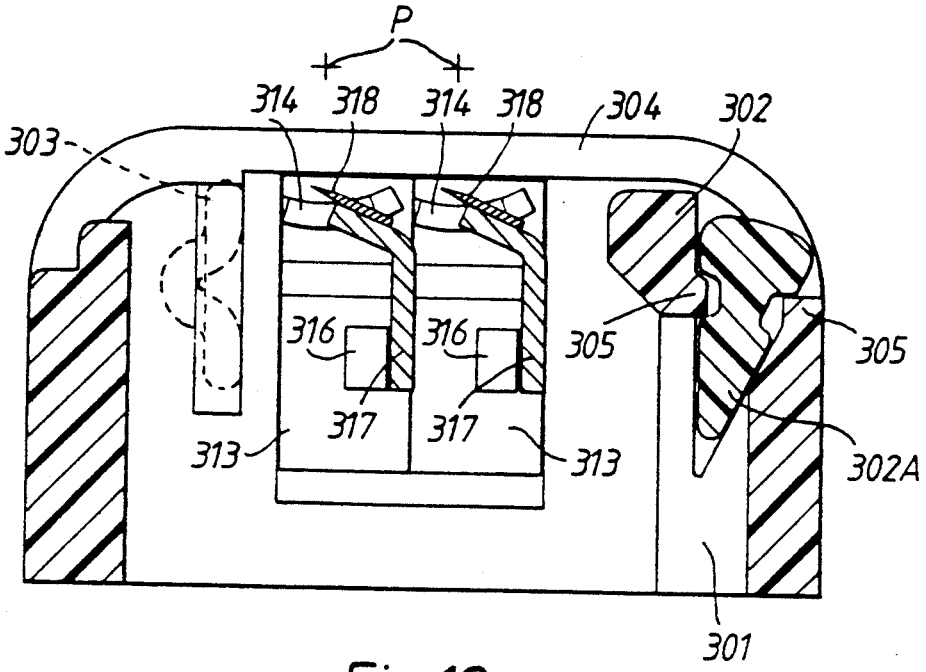
Figure 13:
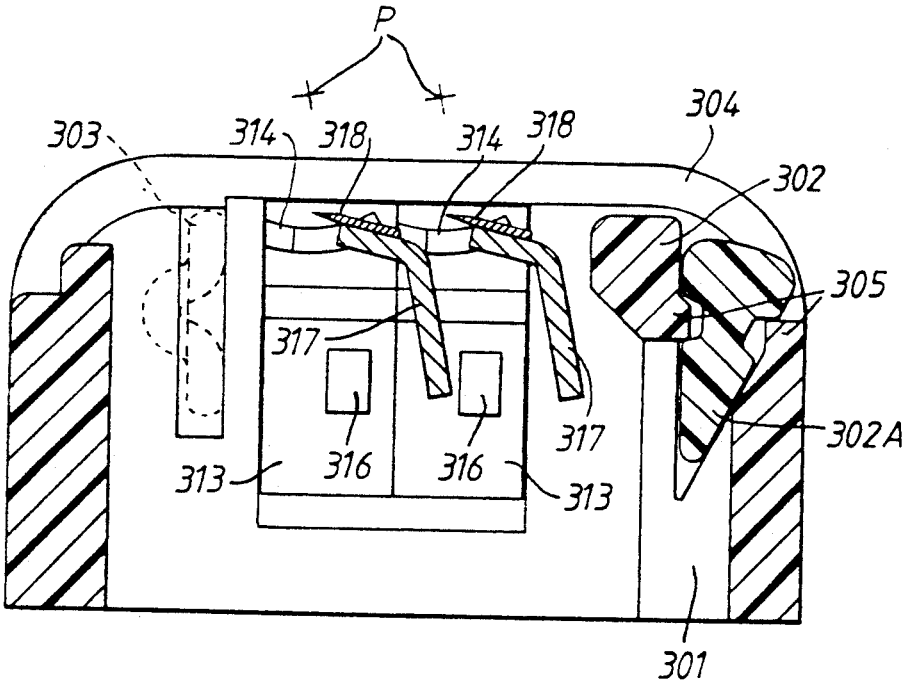

FIGS. 11, 12 and 13 are views corresponding to FIGS. 4, 5 and 6, showing yet another form of razor head in accordance with the invention, the cross-sections of FIGS. 12 and 13 being taken along the line XII—XII in FIG. 11.

Figure 1:
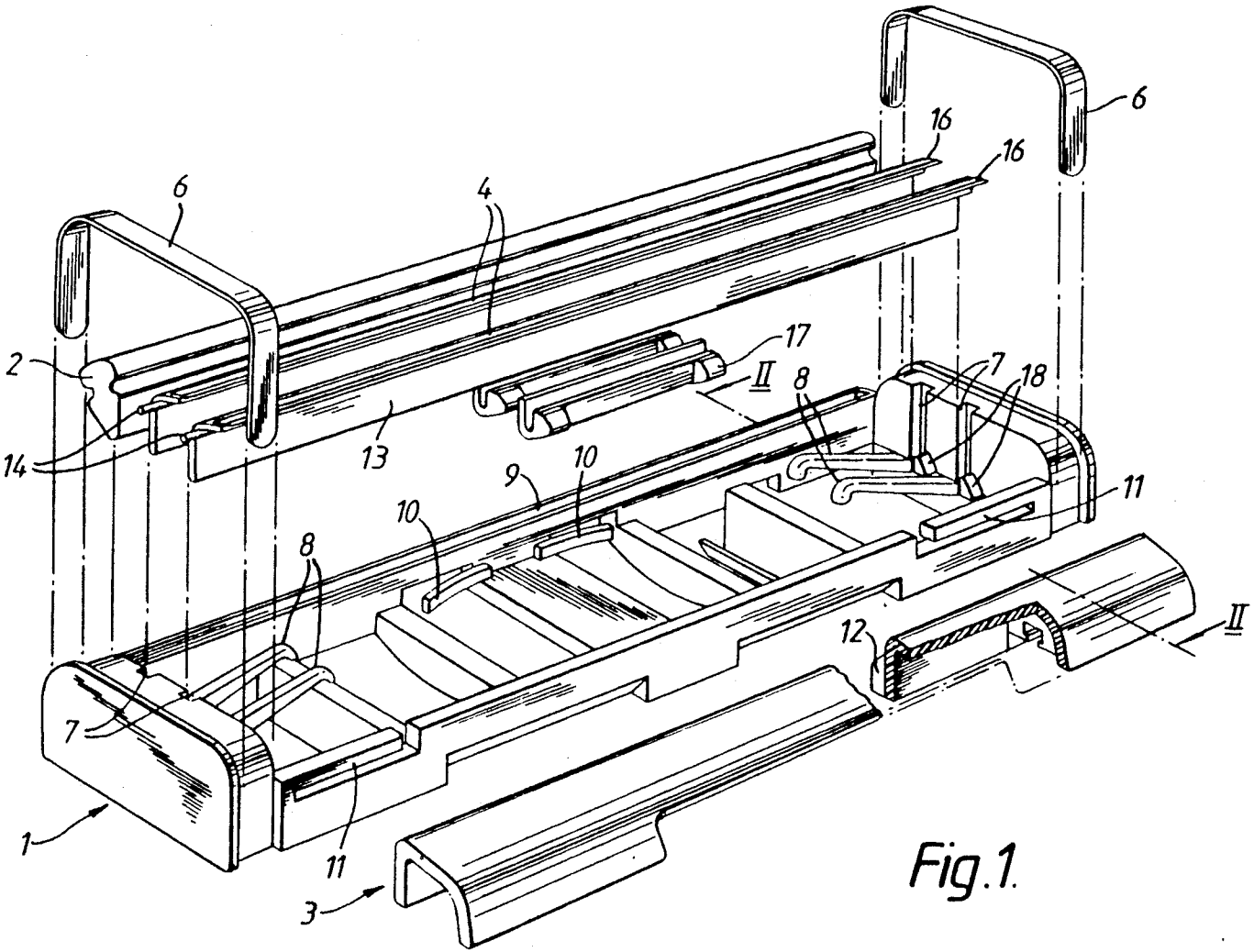
FIG. 1 is an exploded perspective view of a razor head in accordance with the invention.
Figure 2:
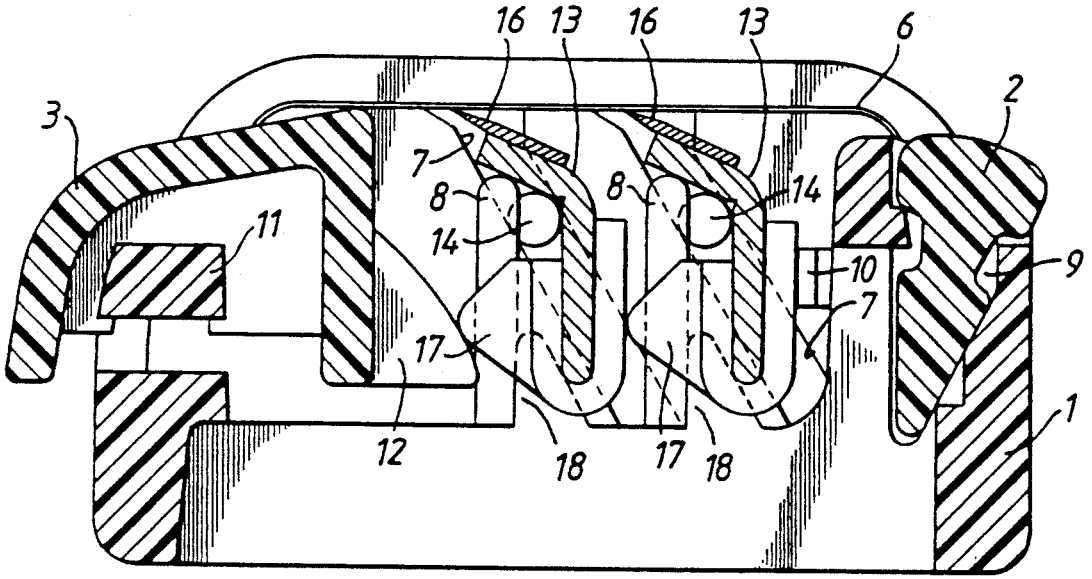
FIG. 2 is a cross-section, on a larger scale, taken along the line II—II in FIG. 1 and also and illustrating a modification to the razor head of FIG. 1.

The razor head shown in FIGS. 1 and 2 is in the form of a replaceable blade cartridge comprising a generally rectangular base frame 1 supporting a cap 2, a guard 3, a pair of blade members 4 and a pair of retaining clips 6.

The frame 1 is formed in its end walls with slots 7 to receive and guide the blade members and, beneath the slots and in longitudinal alignment therewith, integral spring fingers 8 inclined upwardly to free ends which act on the blade members to urge the blade members upwardly in their slots. As shown in FIG. 1, the slots 7 are substantially upright, i.e. perpendicular to the plane in which the blade edges lie in their rest position, whereas in the modified construction illustrated in FIG. 2 the slots are inclined downwardly and rearwardly with respect to said plane, the effect of which is explained below. The slots are provided to enable vertical movement of the blade member, but are not essential for the purposes of the present application. In an alternative embodiment (not separately illustrated) of the razor head as shown in FIGS. 1 and 2, the blade members are mounted in the frame for pivotal movement only, there being no slots in the frame or any other means providing for vertical movement of the blade members.

The cap 2 is retained fixedly in a recess 9 at the rear longitudinal wall of the frame. The front wall of the frame is formed integrally with spring fingers or bars 11 to which the guard 3 is attached locally, as best seen in FIG. 2, so that the guard is resiliently displaceable, by flexing of the bars 11, both rearwardly and downwardly relative to the frame.

The rear, inner face of the guard 3 carries a rearwardly projecting nib or bumper 12 for cooperation with the blade members, as described below.

The blade members each consist of an angular metallic support 13 of substantially inverted L-shape and having secured to each end a pivot pin 14 which is received in a respective end wall slot 7. A narrow blade strip 16 is attached to the inclined upper leg of the support 13, in known manner. The spring fingers 8 act on the underside of those parts of the supports carrying the blade strips and urge the blade members upwardly, so that the extreme ends of the blade strips 16 bear against the clips 6, which thus limit their upward movement.

In their central regions, the supports 13 are fitted with generally u-shaped clips on which are provided abutments, or blade bumpers 17, aligned with the guard bumper 12.

Integral springs 10 formed at the rear of the frame 1 bear on the rear blade support 13, tending to pivot the member in a clockwise direction as seen in FIG. 2, this pivotal movement being limited by a stop 18 formed on the frame. The rear blade bumper 17 bears against the forward blade bumper, to urge the forward blade against its own stop 18 and against the guard bumper 12. The rear faces of the stops 18 against which the blade supports abut are parallel to the slots 7 and hence are substantially upright for the razor head of FIG. 1 and in the case of the modified razor head of FIG. 2 are inclined downwardly and rearwardly. Similarly, the abutment face of the bumper 12 is substantially parallel to the slots 7 and the rear faces of the stops 18.

In FIG. 2, the components are all shown in their normal or rest position, with no external forces applied to them.

Assuming at first the guard to be immobile, the blade members are free to move along the slots 7, against the resilient restoring forces of the spring fingers 8, to permit the blades to conform closely to the varying contours of the skin being shaved. In this respect, the razor operates in the manner of the razor described in U.S. Pat. No. 4,492,025. There is no pivoting of the blade members due to the parallel relationship between the slots 7 and the abutment faces of the stops 18 and the bumper 12.

Now assume that the guard member is deflected downwardly in response to the normal forces applied to it in shaving. In this case the guard bumper 12 will slide over the blade bumpers 17. Again the blades are able to move bodily along the slots 7, but there is no pivotal movement as they are maintained in abutment with and restrained by the stops 18.

In practice, however, the guard will also experience drag forces, and if these are sufficient to overcome the spring forces applied to the guard by its supporting bars 11 and by the springs 10 integral with the frame and bearing forwardly on the guard through the blade supports and the bumpers 17, 12, the guard will also be displaced rearwardly. This rearward motion of the guard will be transmitted through the bumpers 12 and 17 to the lower legs of the blade supports to cause them to move away the stops 18 and hence cause the blade members to pivot anti-clockwise about the axes of pins 14 and thus reduce the shaving angles of the blade strips. The amount by which the shaving angle is reduced is dependent on the rearward displacement of the guard and hence the drag forces.

As mentioned above, in the razor head of FIG. 1, the slots 7 are vertical, in which case rearward movement of the guard will cause pivoting of the blade members. In such a case, the guard could be constrained to move only forwardly and rearwardly, i.e. parallel with the shaving direction.

In the razor head of FIG. 2 the surface of the bumper 12 on the guard 3, which bears against the bumper 17 on the front blade member, is inclined to the vertical so that pivotal adjustment of the blade members is dependent upon the direction in which the guard is displaced from its rest position. The particular angle at which the bumper surface is inclined is not itself crucial and may vary within a wide range as the direction in which the guard moves under an applied force will depend not only the direction of that force, but also other factors such as the relative strengths of the spring forces acting on the guard member to oppose rearward movement and normal movement. Furthermore, the inclination selected will be influenced by the desired change in blade shaving angle in response to guard member movement. In use the guard member is subjected, not only to drag forces (parallel with the direction of shaving) but also to "normal" forces perpendicular thereto, so that in practice it experiences a resultant force inclined downwardly and rearwardly. Since both the drag and normal forces vary during shaving, the angle of the resultant force will also vary but an optimum "threshold" angle can be determined empirically. When the resultant force acts at an angle in excess of the threshold angle, indicating that the drag forces are high relative to the normal forces, the blades are caused to pivot to reduce their shaving angles by appropriate choice of the inclination of the abutment surface of the bumper 12 on the guard member. If the spring forces acting on the guard member to oppose rearward movement and normal movement are equal, the angle at which the rear surface of the bumper is inclined to the normal will be substantially the same as the selected threshold angle of the resultant force, and as shown in FIG. 2 this angle is about 30°, the slight convex curvature shown allowing for torsional deflection of the guard support bars 11. For convenience, the slots 7 are arranged to be inclined at a corresponding angle so that downward deflection of the forward blade member from its rest position does not result in pivotal movement of this blade member due to the influence of the inclined rear surface of the bumper 12. For similar reason the abutment faces of the stops 18 are also arranged at the same angle, i.e. parallel to the slots 7. It will be understood that when the guard member is displaced downwardly and rearwardly in a direction inclined to the vertical at an angle greater than that at which the rear surface of the bumper is inclined to the vertical, i.e. the threshold angle, due to the bumper 12 the blades will be pivoted to reduce their shaving angles.

In use of the razor, the resultant force angle varies continuously. When it is close to the normal direction, the guard bumper 12 separates from the forward blade bumper 17, and there is no pivotal movement of the blade members to change the shaving angle. When the resultant force angle coincides with the angle of the slots 7, the guard bumper slides along the forward blade bumper 17 without exerting any rearward pressure to it and again there is no pivotal adjustment of the blade members. However, when the resultant force is at an angle which exceeds the threshold angle, rearward movement of the guard is transmitted to the blade members to cause them to pivot about the axes of the pins 14 and the shaving angles of the blades to be reduced in proportion to the actual resultant force angle.

From the foregoing description it will be appreciated that the blade members may be arranged to have, in their rest position, a shaving angle which is optimally suited to shaving conditions when low drag forces are experienced, such as when shaving with the grain. On the other hand when relatively large drag forces are encountered, e.g. due to movement against the grain, the blade members will automatically adjust to reduce their shaving angles to suit these conditions. Thus the need to compromise by choosing one shaving angle for all conditions is avoided.

Figure 3:
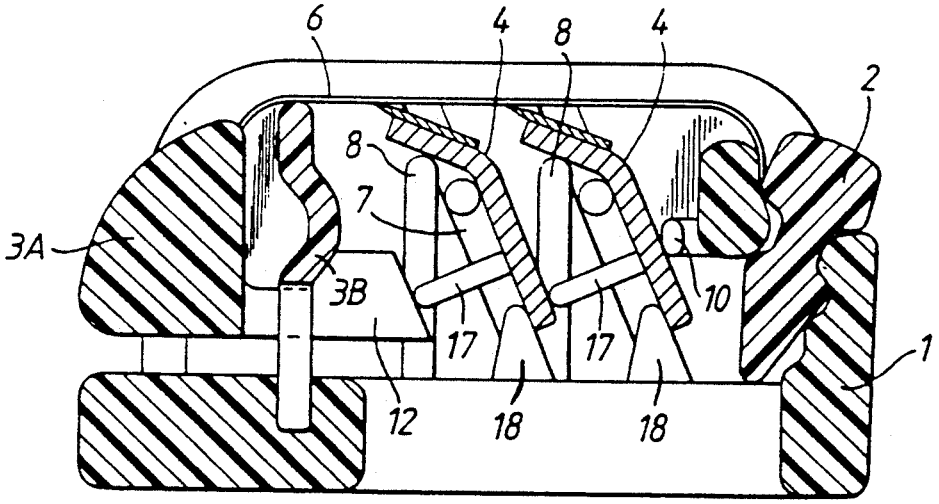
FIG. 3 is a cross-section similar to FIG. 2 and illustrating modified embodiment of the razor head.

The embodiment of FIG. 3 is similar in construction and operation to that of FIG. 2, but the guard is modified. More particularly, the guard here comprises a displaceable forward section 3A, and a fixed, rear section 3B. The forward section 3A is displaceable, in the manner described above, i.e. rearwardly under drag forces and downwardly under normal forces, and includes the bumper 12 with an abutment face parallel to the slots 7. The narrow, rear section 3B is fixed to the frame in order to preserve a minimum span between itself and the forward blade. The rear section 3B could alternatively be constrained for vertical ("normal") movement and urged upwardly by spring means.

The bumpers 17 fitted to the blade supports are shown to be of different form and comprise pegs or plates fastened to the supports, but they function in exactly the same way as the bumpers 17 of the FIG. 2 razor head. Thus when the forward section 3A of the guard is displaced in a direction inclined at an angle greater than that at which the slots 7, and the operative faces of the bumper 12 and the stops 18 are inclined to the normal, the blade members are caused to pivot to reduce their shaving angles.

FIGS. 4, 5 and 6 illustrate a further embodiment of the invention, generally similar to that of FIG. 2, but having a "two part" guard, modified bumpers and repositioned pivot pins.

More particularly, the guard comprises a fixed forward portion 103A integral with the frame 101 and a rear portion 103B which is displaceable both rearwardly and downwardly from the position illustrated in FIG. 5 against the action of resilient sections 111 formed integrally with the portion 103B and corresponding in function to the bars 11 of FIGS. 1 and 2.

The guard bumper 112 is shaped so that in the rest position shown in FIG. 5 it makes face-to-face contact with the bumper 117 of the leading blade unit, these bumper faces being essentially parallel with slots 107 in the end walls of the frame and in which the pins 114 of the blade members engage. The stops 118 serve the same purpose as the stops 18 in FIGS. 2 and 3, and likewise have abutment faces parallel to the slots 107.

Finally, in this embodiment the pivot pins 114 are secured to the blade units 104 above the blade platforms so as to be engageable with the underside of the retaining clips 106. The springs 108 bear upwardly on the undersides of the blade platforms 113, between the pins 114 and the blade edges, which also engage the clip so that the units are biassed into the stable position of rest seen in FIG. 5.

While FIG. 5 shows the parts in their normal position of rest, FIG. 6 shows them deflected as a consequence of movement of the guard portion 103B both downwardly and rearwardly, i.e., under normal and drag forces. As in the case of the embodiments of FIGS. 2 and 3, displacement of the guard portion 103B in a direction inclined to the normal at an angle greater than that at which the slots 107 and the abutment faces of the stops 118 and the bumper 112 are inclined to the normal results in the blade members being pivoted about the axes of the pins 114 to reduce the shaving angle of the blades, as clearly depicted in FIG. 6.

Figure 7:
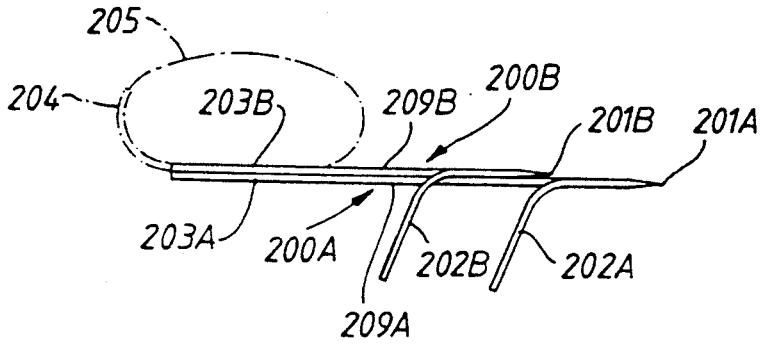
FIGS. 7 and 8 are an end view and scrap perspective view respectively, of an integral twin-blade unit for use in the razor head of FIGS. 9 and 10.
Figure 8:
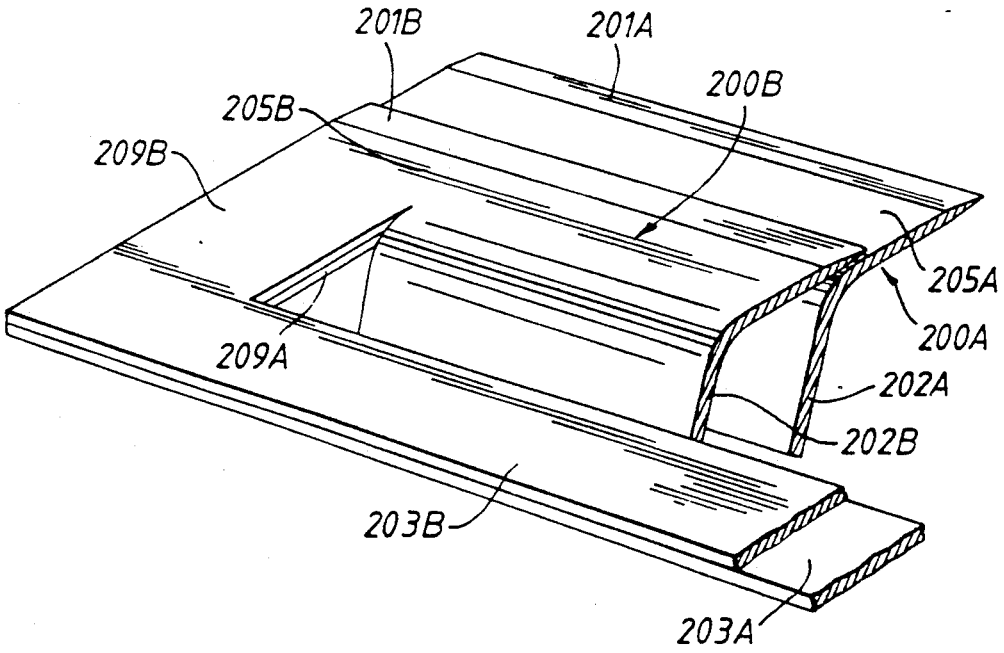
Figure 9:
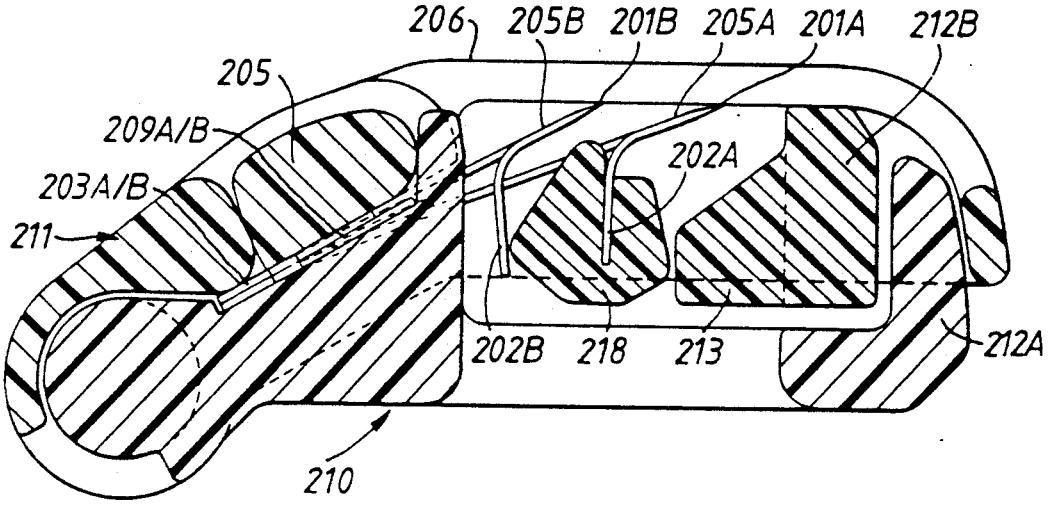
FIGS. 9 and 10 are cross-sections of a further form of razor head, incorporating the blade unit of FIGS. 7 and 8.

In the razor shown in FIGS. 7 to 9, the blade members are of a completely different construction and instead of pivoting about fixed axes defined by pins they flex or hinge about axes parallel with their blade edges thanks to the flexure of spring arms integral with the blades.

FIG. 7 is an end view and FIG. 8 a scrap perspective view of one end portion of a twin blade unit comprising two separate blade members 200A and 200B having respective sharpened cutting edges 201A, 201B, formed on blade strip portions 205A, 205B, and downturned legs 202A, 202B which serve to stiffen the strip portions 205A, 205B. The rear margins 203A, 203B of the blade members are superposed and directly secured to each other, as by spot welding, the rear margins remaining connected to the blade strips only by spring arms 209A, 209B at opposite ends of each unit. The two members are generally planar in their "free" condition, except for the legs 202A/B being turned down out of the main plane, but the blade strip portions 205A/B can be separated from each other by flexure of the arms 209A/B. FIG. 7 also shows an optional strip 205 of lubricating material retained by clips 204.

Turning now to FIG. 9, the above described twin blade unit is shown mounted in a razor frame 210 having a hinging cap portion 211 incorporating end clips 206 (like the clips 6 shown in FIG. 1). When the cap portion is closed, as shown in FIG. 9, the rear margins 203A/B are turned down and clamped, the strip portions 205A/B being retained at their sharpened edges by the clips 206 against which they are spring loaded by the strain energy in the spring arms 209A/B.

The razor also comprises a spring loaded displaceable guard portion 212B displaceable rearwardly and downwardly in use in the same manner as the guard portion 103B in FIGS. 4, 5 and 6, and a forward, fixed guard portion 212A corresponding to the portion 103A in FIGS. 5 and 6.

In its medial region, the guard portion 212B has a rearwardly extending bumper 213 engageable with a bumper 218 attached to the leg 202A of the leading blade member and engageable in turn with the leg 202B of the rear blade member.

Figure 10:
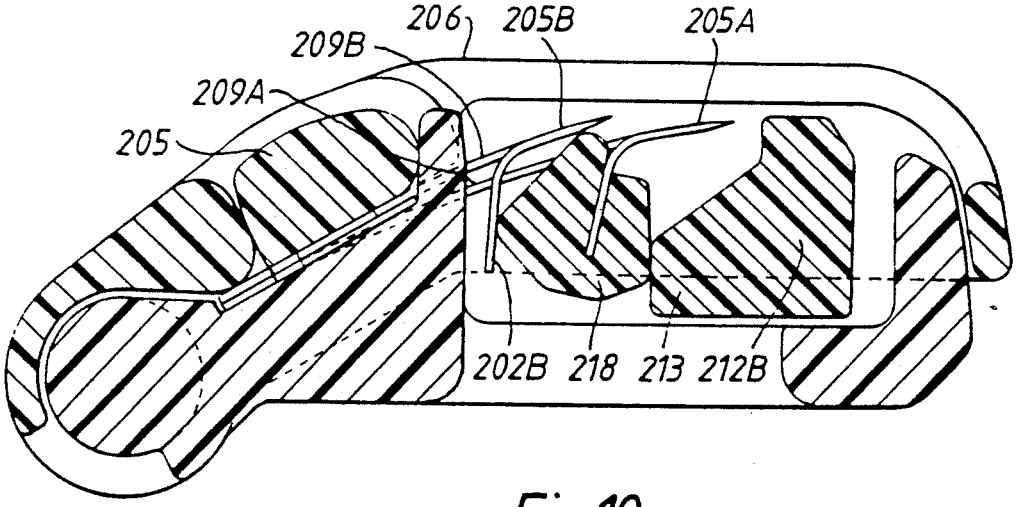

As in the previous embodiments, if the guard portion 212B is displaced rearwardly, due to encountering high drag forces, its bumper 213 engages the bumper 218 which in turn engages the leg 202B, causing both legs to be tilted rearwardly with concomitant flexure of the spring arms 209A/B and consequent deflection or angling of the blade strip portions 205A/B in a clockwise sense as viewed in FIGS. 9 and 10, i.e. so that the blade edges move downwardly and forwardly, to reduce their respective shaving angles.

The abutment face of the bumper 213 is essentially vertical so that downward displacement of the guard portion 212B does not produce any movement of the blades. It could alternatively be inclined as in the razor heads of FIGS. 2–6 so that the movement of the blades to reduce their shaving angles is dependent upon the direction in which the guard portion 212B is displaced under the resultant of the drag and normal forces.

In all of the above described embodiments, drag forces are essentially detected by a skin engaging guard member which is rearwardly displaceable, against the action of a resilient restoring force, and this motion is transmitted to the blades to effect a reduction in their shaving angle.

However, in the razor illustrated in FIGS. 11 to 13, the guard is (or may be) rigid and it is drag forces applied to the blade edges which will, if sufficiently high, effect a reduction in shaving angle. Broadly speaking, this is achieved by virtue of the fact that blade members are mounted for pivotal movement about axes parallel with the blade edges and spaced above the blade strips, "above" being used in the sense of higher than the blades when the razor is in an upright attitude with the skin engaging surfaces uppermost.

Referring now to FIGS. 11 to 13 in detail, the razor head illustrated is in the form of a replaceable blade cartridge comprising a generally rectangular base frame 301 including a cap 302, a guard 303, opposed end cheeks 304, a moulded blade carrier 306 and a pair of blade members 307.

The guard 303 is located in guide slots in the ends of frame 301 and is retained by the cheeks 304 in known manner. A lubricating strip 302A is secured in a slot in the frame by shoulders 305.

The blade carrier 306 is of unitary moulded construction comprising a central frame 308 across which extend oppositely directed spring arms 309 having upwardly projecting abutments 311 at their free, inner ends. At each of its ends, the frame has integrally formed with it a pair of outwardly and upwardly extending spring fingers 312 carrying at their outer ends respective support blocks 313, each formed on its inner face with an arcuate groove 314 and a blade stop 316.

Each blade comprises an angular metallic blade support 317 having secured to its upper leg a narrow blade strip 318 with a sharpened, longitudinal cutting edge. The support is additionally formed at each end with an integral male bearing member 319 of arcuate form.

In the assembled cartridge, the carrier is firmly located in the frame 301 and the blade members are supported by their bearing members 319 being received in the grooves 314 of the blocks 313. The bearing members 319 in conjunction with the arcuate slots in the blocks form shell bearings to guide the blade members for pivotal movement. The abutments 311 engage the respective blade supports 317 from the rear, urging the blade members in a clockwise direction, as viewed in FIGS. 12 and 13, to one extreme pivotal position of adjustment about the imaginary pivot axes 'P' which coincide with the centres of curvature of the arcuate grooves 314 and bearing members 319. In this position which is shown in FIG. 12, the blade supports abut the stops 316.

In use of the razor, when the individual blades experience drag forces sufficient to overcome the biasing forces exerted on them by the spring arms 309, the blade members are moved rearwardly and as a result of the arcuate form of the bearing members 319 and the grooves the blade members are displaced in an anti-clockwise direction about the pivot axes P so as to reduce the shaving angles of the blades. In the extreme case shown in FIG. 13, this movement is limited by abutment of the blade bearings 319 with the ends of the arcuate slots 314. In the normal or starting attitude of the blade members, the shaving angle of each blade is set at about 28°, and in the opposite extreme position it is reduced to 15°.

Because of their independent mounting, the two blades can assume different shaving angles, in accordance with different drag forces applied to them.

With this arrangement, the shaving angles of the blades are reduced in response to the presence of relatively high drag forces, whether caused by the fact that the blades are working against the local grain of the hair, or by local bulging of the skin, or both, so as to optimise the angle of attack of the blades against the hairs and minimise damage to the skin in that locality.

The blade members are also able to move, independently of each other, in directions perpendicular to the shaving directions under the action of normal forces experienced in use, principally arising from the pressure applied by the user in holding the razor against the skin. These movements are accommodated by displacement of the individual blocks 313 against the resilient restoring forces of the spring fingers 312.

In each of the above described embodiments, various modifications will, of course, be possible within the scope of the present invention. For example, each of the razor heads may be permanently associated with a handle, instead of constituting an exchangeable cartridge. One blade member may be employed, or three or more.

I claim:

1. A safety razor comprising a frame supporting one or more blade members in a manner permitting movement of the blade members, relative to the frame, against resilient restoring forces, in response to the forces encountered by the razor in use, characterized in that the or each blade member (16, 116, 205A/B, 318) is mounted separately by means in the frame for angular movement independently of the frame and other blade in the frame about an axis parallel with the blade edge, in a direction which reduces the shaving angle of the for each blade member in response to an increase in drag forces acting parallel with the direction of shaving.

2. A safety razor according to claim 1, characterized in that the (or each) blade member (16, 116, 205A/B, 318) is provided with pivotal mounting means (14, 114, 319) supported in the said frame (1, 101, 301).

3. A safety razor according to claim 2, characterized in that the (or each) blade member (307) is supported in the frame (301, 306) by shell bearings (314, 319) for angular displacement about a fixed imaginary pivotal axis (P) parallel with the blade edge (317) and so positioned that drag forces experienced by the blade edge cause the blade member to pivot about the said axis to reduce the shaving angle.

4. A safety razor according to claim 3, characterized in that two blade members (307) are supported in a blade carrier (306) comprising respective integral springs (309) acting to urge the blade members to an extreme position in which their shaving angles are at a maximum value, and also incorporating spring mounted support blocks (313) having shell bearing means (314)

for supporting the blade members, the blade carrier in turn being supported in the frame (301).

5. A safety razor according to claim 1, wherein the said pivotal mounting means comprises pivot pins (14, 114) at each end of the (or each) blade member (4, 104) received in co-operating recesses (7, 107) in end walls of the frame (1, 101).

6. A safety razor according to claim 5, characterized in that the said recesses are formed by elongate slots (7, 107), the said slots extending essentially transversely to a notional plane tangent to respective skin engaging surfaces (2, 3; 102, 103) of the razor, and the (or each) said blade member is biassed upwardly, outwardly of the frame by resilient means (8; 108).

7. A safety razor according to claim 6, characterized in that the said slots (7; 107) extend downwardly and rearwardly in the frame (1; 101).

8. A safety razor according to claim 1, characterized in that the said razor includes a guard member (3; 3A; 103B; 212B) mounted in the frame for rearward displacement relative thereto, against the action of resilient restoring forces, and that said displacement is transmitted to the (or each) said blade member (4; 104; 205A/B) to reduce its shaving angle.

9. A safety razor according to claim 8, characterized in that the said guard member (3; 103B; 212B) is also displaceable downwardly relative to the frame, in response to the application to it of normal forces perpendicular to the said drag forces, and that displacements of the guard member are only transmitted to the (or each) blade member when the resultant of the drag and normal forces acts to displace the guard along a line of action exceeding a predetermined threshold angle.

10. A safety razor according to claim 8, characterized in that the said guard member is constrained to move parallel with the direction of shaving.

11. A safety razor according to claim 8, characterized in that the (or each) said blade member (200A/B) comprises a blade strip portion (205A/B) integral with spring arms (209A/B) supporting the blade strip portion (205A/B) in the said frame (210, 211) for hinging movement about an axis parallel with the said blade edge (201A/B) in response to rearward displacement of the said guard member (212B).

12. A safety razor according to claim 1, comprising at least two blade members (4), each of which comprises a support (13) of inverted L-shape having a blade strip (16) secured to its upper limb thereof, the supports having depending limbs in abutting engagement with each other so that angular deflection of one blade member is transmitted directly to the other.

* * * * *